United States Patent [19]

Dumont

[11] 4,094,156

[45] June 13, 1978

[54] METHOD AND APPARATUS FOR DRIVING SHEET PILES INTO THE GROUND

[75] Inventor: Fritz Dumont, Dortmund-Persebeck, Germany

[73] Assignee: Baugesellschaft Klammt KG, Hagen, Germany

[21] Appl. No.: 448,764

[22] Filed: Mar. 6, 1974

[30] Foreign Application Priority Data

| | | |
|---|---|---|
| Mar. 10, 1973 | Germany | 2312032 |
| Feb. 9, 1974 | Germany | 2406283 |

[51] Int. Cl.[2] ..... E02D 7/26

[52] U.S. Cl. ..... 61/53.5; 61/60; 175/171

[58] Field of Search ..... 61/53.5, 53.74, 58, 61/59, 60, 61, 62, 63; 175/171, 108

[56] References Cited

U.S. PATENT DOCUMENTS

| | | | |
|---|---|---|---|
| 2,791,886 | 5/1957 | Veder | 61/35 X |
| 3,499,293 | 3/1970 | Kato | 61/53.5 |
| 3,696,625 | 10/1972 | Alexander | 61/53.5 |

FOREIGN PATENT DOCUMENTS

| | | | |
|---|---|---|---|
| 644,992 | 5/1937 | Germany | 61/60 |

*Primary Examiner*—Jacob Shapiro
*Attorney, Agent, or Firm*—Spencer & Kaye

[57] ABSTRACT

In order to facilitate or make possible the driving of sheet pile planks and the like into the ground, adjacent the location where the sheet pile planks are to be driven in, there is provided a cavity in the ground for at least partially receiving the soil as it is displaced during the pile driving operation. The cavity is provided not later than during the driving-in of the sheet pile planks.

14 Claims, 9 Drawing Figures

METHOD AND APPARATUS FOR DRIVING SHEET PILES INTO THE GROUND

BACKGROUND OF THE INVENTION

The present invention relates to a method and apparatus for driving sheet pile planks and the like into the ground.

With the prior art methods and apparatuses it has been possible to drive sheet pile planks and the like only into cohesive and loosely or half-tightly packed, fine-grained soil, such as clay and silt (water-containing, fine-grained soil). Depending on the type of soil, the amount of energy required varies.

It is, however, practically impossible to drive sheet pile planks and the like into tightly packed noncohesive soil, such as sand or gravel, even if great amounts of energy are expended.

SUMMARY OF THE INVENTION

It is an object of the present invention to provide a process and an apparatus which make it possible to drive sheet pile planks and the like even into difficult soil, or, under normal soil conditions to operate with substantially reduced energy and time input.

This object and others to become apparent as the specification progresses, are accomplished by the invention, according to which, briefly stated, a cavity is made, for example by drilling, in the vicinity of the location where the sheet pile plank is to be driven in. The cavity is designed to be of sufficient size to accommodate at least in part, the soil displaced during the pile driving operation.

In case of a soil type into which sheet pile planks could be driven by prior art methods and apparatuses, the heretofore required force may be reduced to one tenth of its value by practicing the invention. Furthermore, by virtue of the invention, the driving of planks into tightly packed noncohesive soil has now become possible.

The apparatus for practicing the above-outlined method comprises a transverse head which accommodates and supports the sheet pile driving mechanism as well as the cavity making (hole drilling) mechanism which is situated adjacent the sheet pile (or plank) driving mechanism.

DESCRIPTION OF THE METHOD

Figure 1:
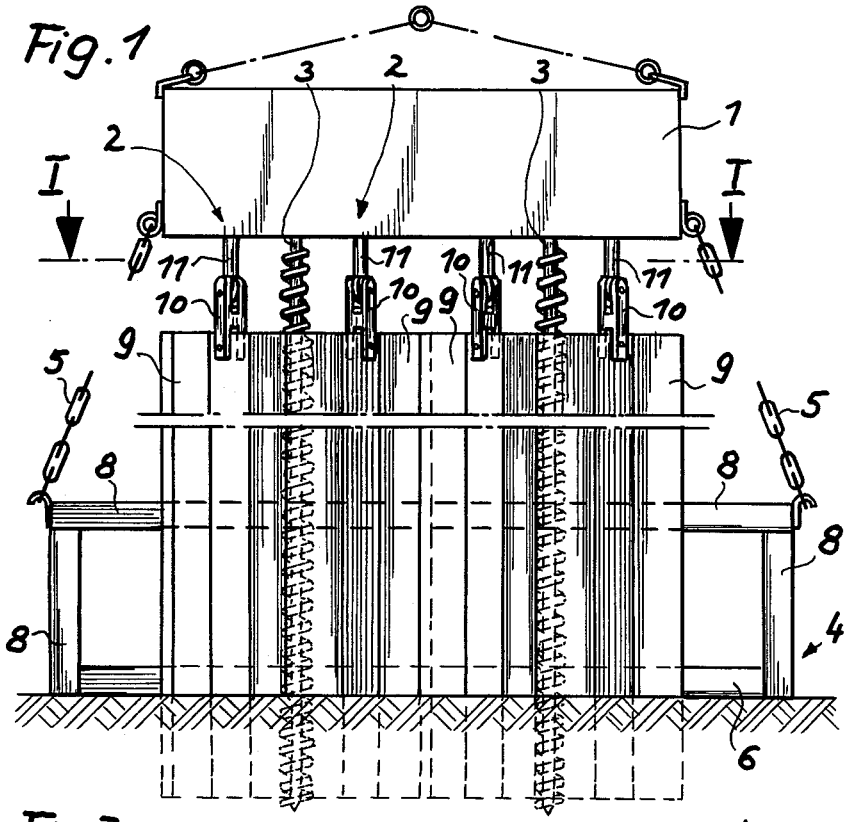
FIG. 1 is a schematic front elevational view of a preferred embodiment of the invention.
Figure 3:
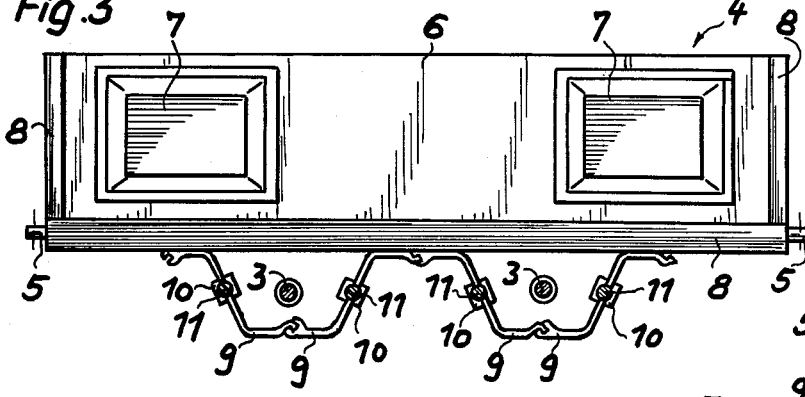
FIG. 3 is a plan view of the same embodiment from line I—I of FIG. 1.
Figure 2:
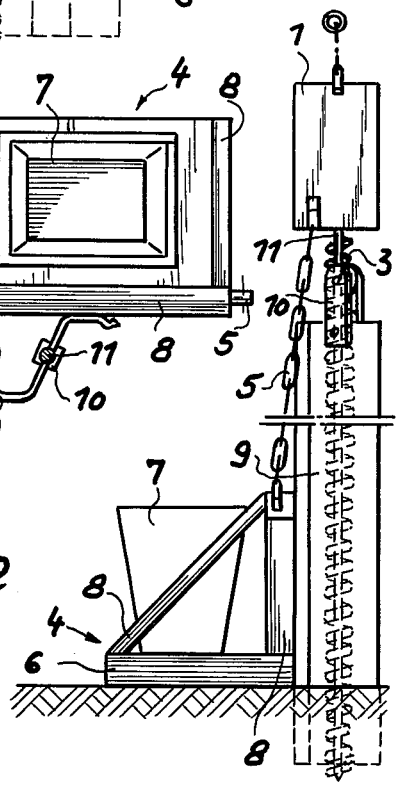
FIG. 2 is a schematic side elevational view of the same embodiment.
Figure 4:
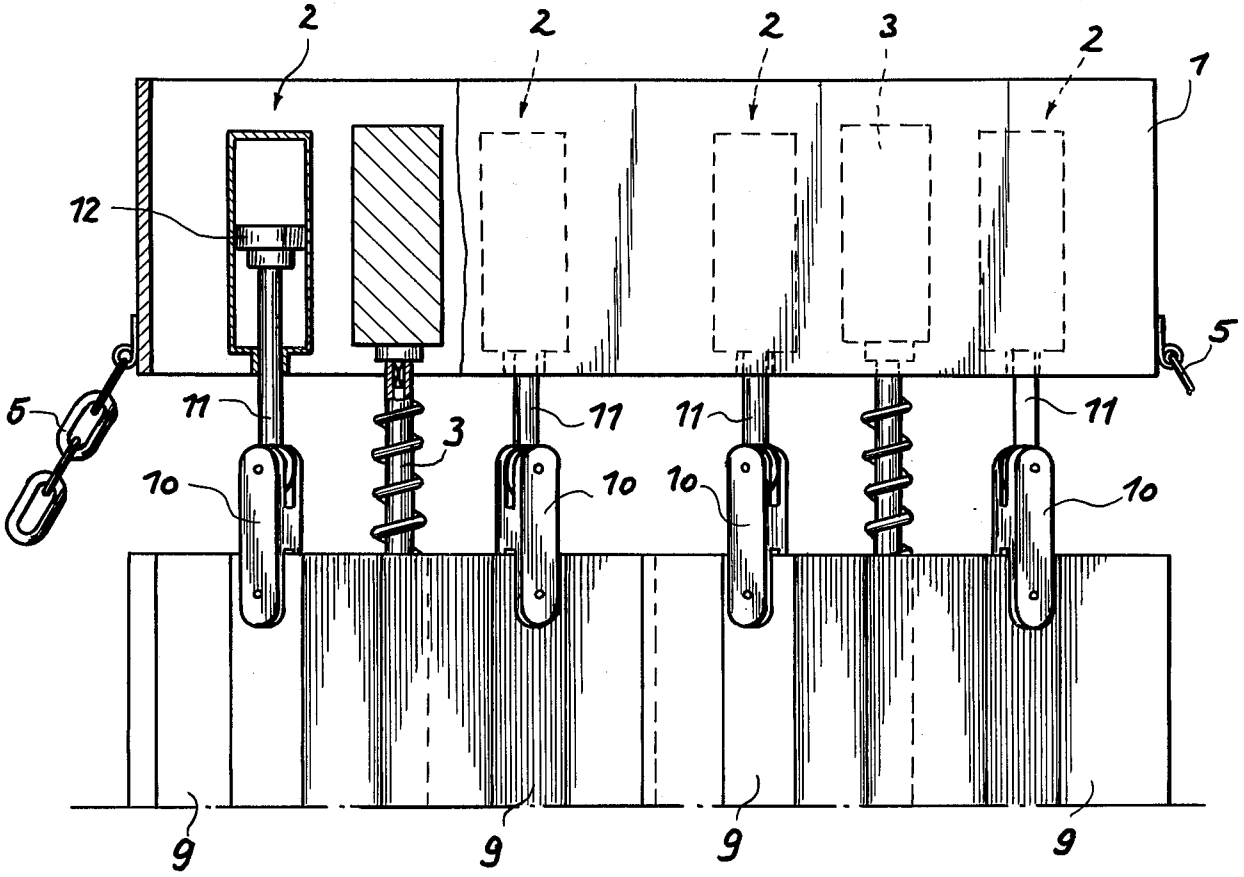
FIG. 4 is a side elevational sectional view of some components of the embodiment as shown in FIG. 1.
Figure 5:
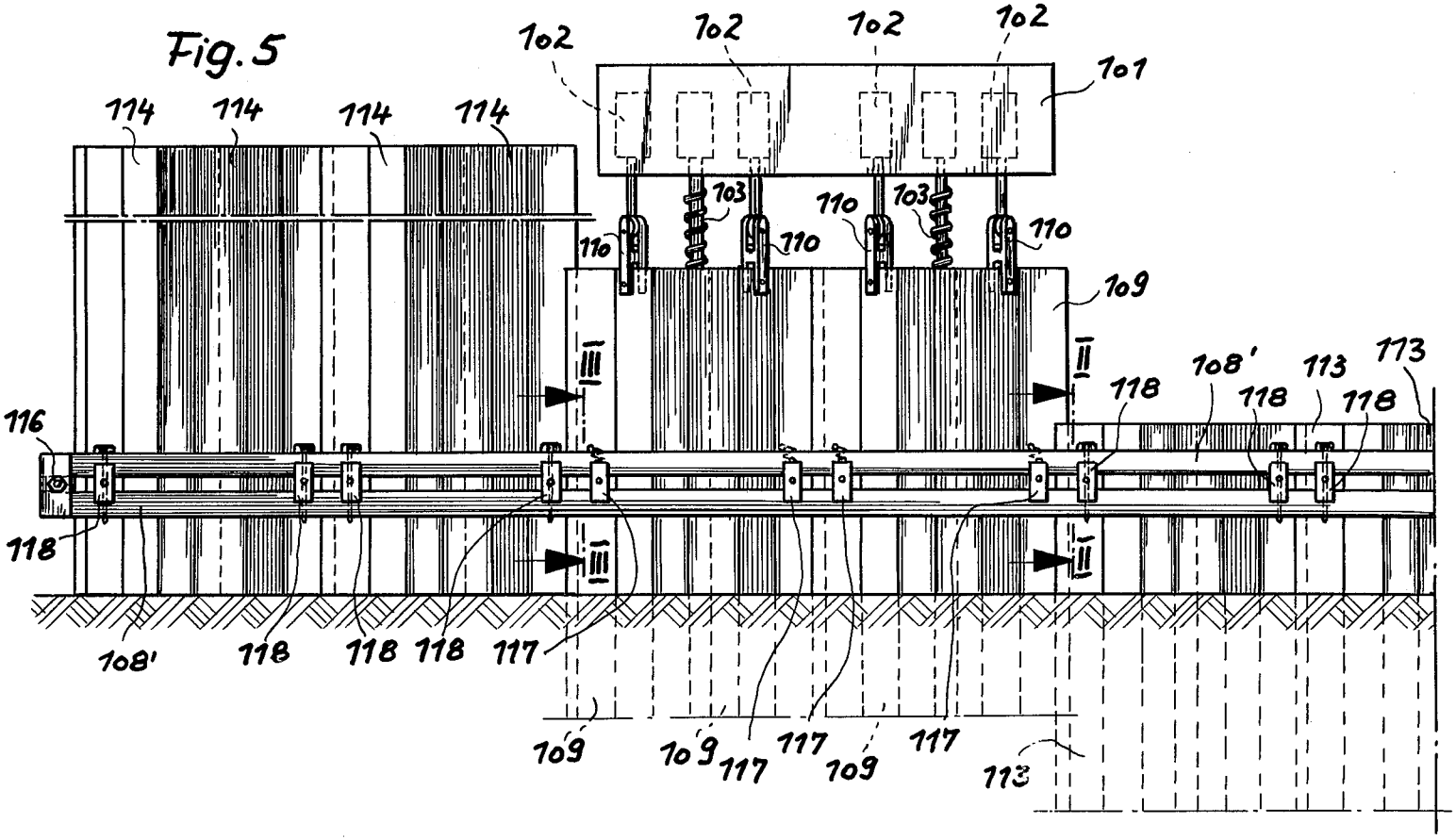
FIG. 5 is a schematic front elevational view of another embodiment which is connected to a sheetpiling.
Figure 6:
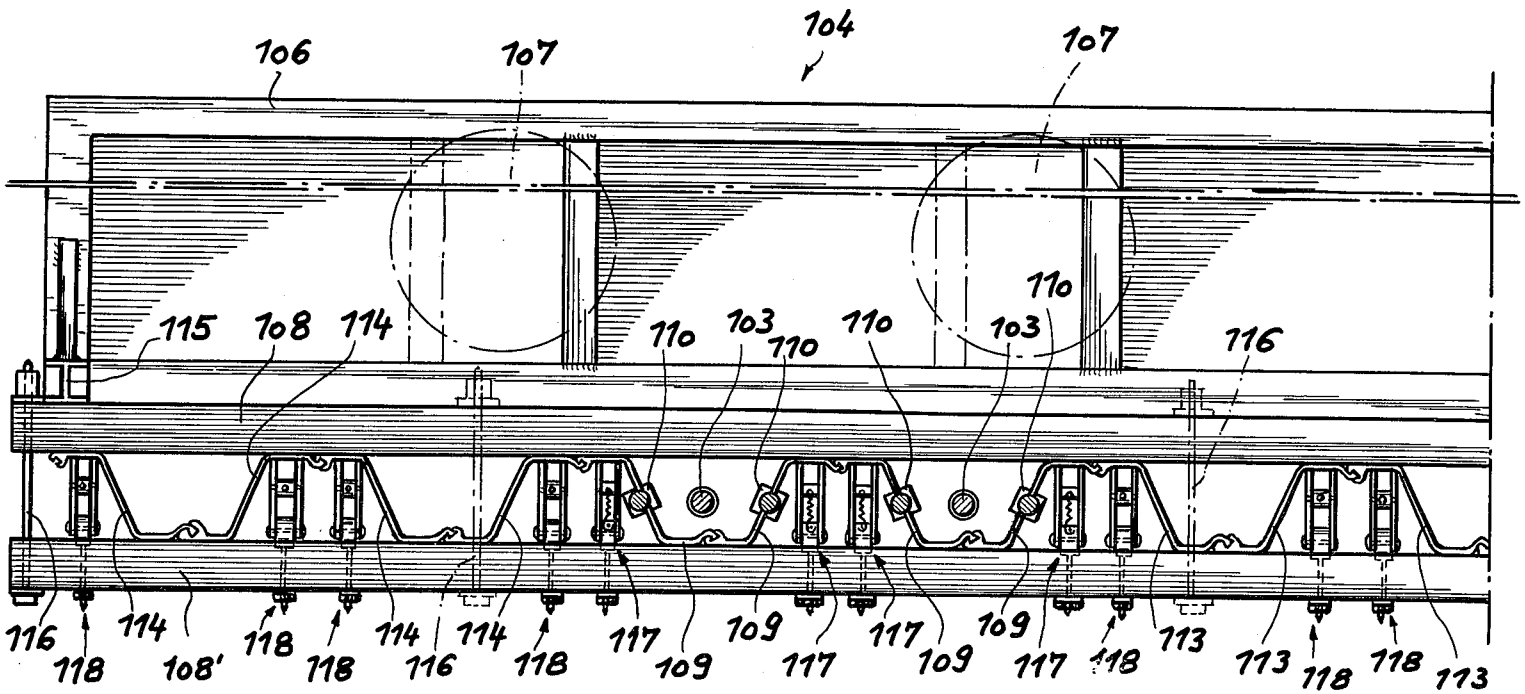
FIG. 6 is a plan view of the same embodiment.
Figure 7:
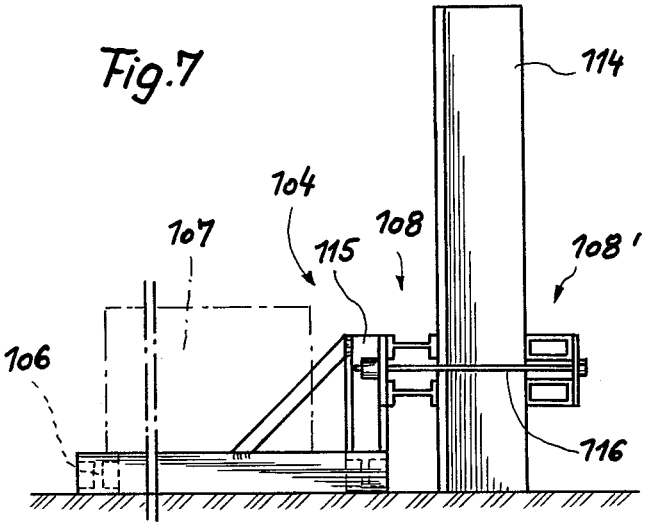
FIG. 7 is a side elevational view of the same embodiment.

To facilitate or make possible the driving of sheet pile planks into the ground, adjacent the location where the planks are driven in, at least one hole is being bored to thus provide a cavity which may take up at least part of the soil as it is displaced by the progressively penetrating plank driven into the ground. The hole drilling operation is effected not later than during the driving of the adjacent planks.

According to an inventive modification of the method of the present invention, the drilling and pile driving are effected alternatingly in stages; the drilling process is adapted to the driving process depending on the type of soil involved and/or depending on the level of groundwater.

Under certain circumstances it may be advantageous to drive and drill simultaneously.

According to a further advantageous and inventive feature of the method, the volume of the hole drilled approximately corresponds to that of the material displaced during the plank driving process. Under certain circumstances it may be particularly advantageous if the drilled hole has a cross section which is approximately equal to that of the plank to be driven in.

It is furthermore advantageous to drill the hole to a depth which corresponds to that to which the plank is driven.

According to an advantageous and inventive variation of the above-described process, the drilling is effected in connection with driving one or a plurality of sheet pile planks or the like only when the peak pressures and the jacket friction at the lateral surface of the planks or the like exceed the drive-in pressure.

According to a further advantageous feature of the above-described method, the planks or the like are driven in by means of static pressures. In this manner the planks or the like can be driven in almost without noise and vibration.

In case of particularly difficult soil conditions, it may be advantageous to drive the planks with pulsating pressure, or to selectively exert static or pulsating pressures on the planks.

Under certain circumstances it may be particularly advantageous to superimpose pulsating pressures over the static pressures during driving in of the planks or the like.

According to a further inventive feature of the above-described method, the walls of the holes are reinforced in such a manner that collapse of the hole upon retraction of the drilling device is prevented and the walls of the hole will yield to the pressure of the soil during the plank driving process. It has been found to be particularly advantageous to fill the drilled hole with a supporting fluid. This prevents that loose soil, such as sand, fills up the bore hole once the drill has been retracted and before the plank or the like has been driven in adjacent the drilled hole. Bentonite enriched with water has been found to be particularly well suited as a supporting fluid.

Upon completion of the plank driving process it is advantageous to fill the bore hole in order to obtain sufficient stability of the sheet pile in the soil. For this reason it is particularly advantageous to employ a hardening material with a delayed setting time.

DESCRIPTION OF THE PREFERRED EMBODIMENTS

Turning now to FIGS. 1,2,3 and 4, the apparatus shown therein comprises a transverse head or substantially horizontally supported head beam 1, pressing devices 2 and drilling devices 3, as well as a framework 4. The transverse head 1 is fastened to the framework 4 with chains 5 or the like. The framework 4 has a bottom plate 6 with vessels 7 which can be filled to provide added weight, and supporting rods 8 to align sheet piles or planks 9 which form a sheetpiling.

The pressing devices 2 which are four in number in the illustrated case, can each be fastened to the head of a sheet pile 9 by means of a clamping element 10.

The clamping elements 10 themselves are each connected to a piston rod 11 of a hydraulic piston 12 (FIG. 4) which can be charged from both sides. Between each two pistons 12 a drilling device 3 is provided which can be raised and lowered within limits. The axial displaceability of the drilling device 3 approximately corresponds to the stroke of piston 12.

It is expedient to provide each drilling device 3 with a hollow drill, hollow drill rods and a water swivel.

In order to keep the sheet piles perpendicular at least at the beginning of the driving process, it is known to suspend the transverse head 1 together with the connected sheet piles 9 or the like from a crane. The bore hole is located at a distance of 10 to 20 centimeters, averaging 15 centimeters, from the sheet piles. The ratio of the cross-sectional area of the bore hole to that of a sheet pile or plank is about 2 to 7, if the soil type is convenient. If the sheet piles are profiled like a Z, they are compounded two by two as the drawings show to a groove profile, the cross section of which has a total area of about 280 square centimeters, each sheet pile having a cross-sectional area of about 140 square centimeters. Amidst the two sheet piles building a groove the bore hole is placed with a cross section of about 80 square centimeters. In case of difficult soil conditions it may be necessary to set a bore hole of about 310 square centimeters for driving in the same sheet piles.

Turning now to the embodiment illustrated in FIGS. 5,6,7,8 and 9, the apparatus includes a transverse head 101, four hydraulic pressing devices 102 and two drilling devices 103 as well as a framework 104. The transverse head 101 is fastened to four sheet piles or planks 109 via the piston rods of the pressing devices. The framework 104 includes a bottom frame 106 with vessels 107 disposed thereon which can be filled, for example with sand, in order to provide added weight, and two pairs of supporting beams 108 and 108' to align the sheet piles.

The piston rod of each pressing device 102 is releasably fastened to the head of a sheet pile 109 by means of a clamping element 110.

Between every two pressing devices 102 there is disposed a drilling device 103 which may be raised and lowered within limits. The axial displaceability of the drilling devices 103 approximately corresponds to the stroke of the hydraulic pressing devices 102 which include power cylinders.

The supporting beam pairs 108 and 108' extend on both sides beyond the sheet piles 109, which are connected with the transverse head 101 via the piston rods of the pressing devices 102, into the region of a plurality of already driven-in sheet piles 113 and into the region of four sheet piles 114 still to be driven in. Stated differently, the beam pairs 108 and 108' extend below the transverse head 101, along and beyond its length dimension, wherein the length dimension is measured parallel to the sheetpiling formed of the sheet piles or planks 109, 113 and 114.

The pair of the supporting beams 108 is fastened to columns 115 which extend from the bottom frame 106 of framework 104, while the pair of supporting beams 108' is clamped, by means of at least two length-adjustable bolts 116 which are fastened to the end pieces of the pair of supporting beams, to the piles 109, 113, 114. The latter are disposed between the pairs of supporting beams 108, 108'. The horizontal spacing between the two beam pairs corresponds to at least the overall thickness of the sheet piles. With this arrangement it is possible to drive sheet piles into the ground at a preselected inclination with respect to the vertical in a more dependable manner than it has been heretofore possible.

Figure 8:
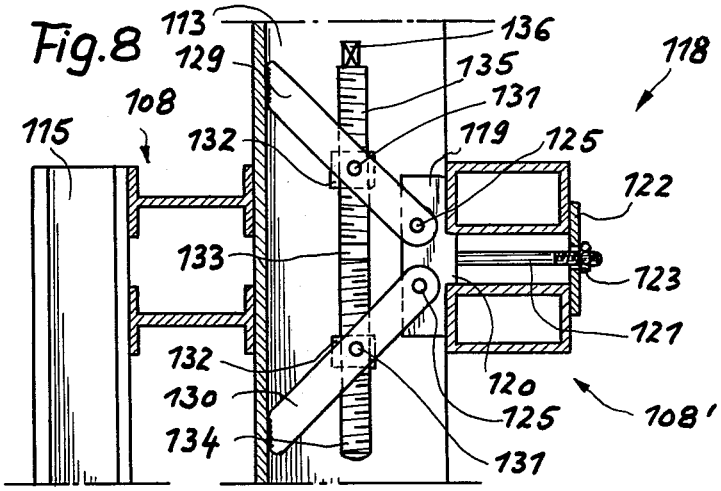
FIG. 8 is an enlarged sectional side elevational view taken along line II—II of FIG. 5.
Figure 9:
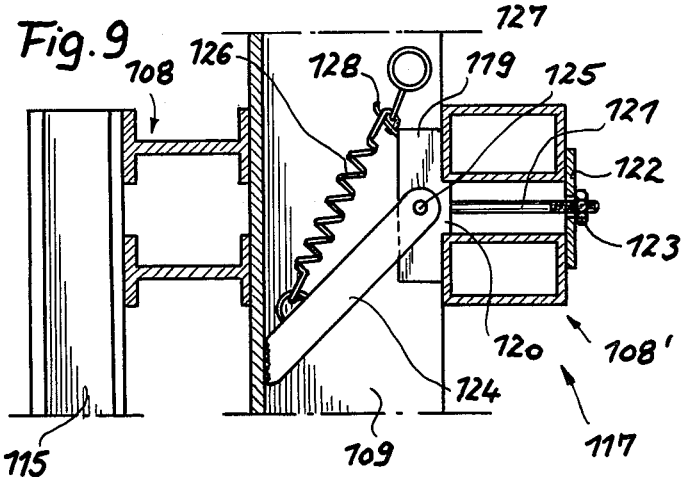
FIG. 9 is an enlarged sectional side elevational view taken along line III—III of FIG. 5.

The two types of couplings illustrated in detail in FIGS. 8 and 9, respectively, both have a form-retaining base plate 119 which, with an integral tongue 120, projects in a form-locking manner into the intermediate space between the pair of supporting beams 108'. Moreover, the base plate 119 is releasably fastened to the pair of supporting beams 108' by means of a bolt 121 which passes through the intermediate space, a butt strap 122 and a nut 123.

Turning now to the coupling 117 shown in FIG. 9, a pair of supporting arms 124 (only one shown) is articulated to the base plate 119 of coupling 117 and is pivotable about an axis 125 which is at a right angle to the driving direction of the sheet piles. The pair of supporting arms 124 is directed obliquely downwardly and is supported in a force-transmitting manner at the sheet pile 109 under the force of a helical tension spring 126 so that the coupling is automatically released when the sheet pile is driven in, but is automatically closed at the latest when pulling forces exerted on the sheet pile are greater then the driving forces. The spring 126 is fastened with its one end to the pair of supporting arms 124 while its other end which is provided with a handle 127, is releasably attached to a hook 128 extending from the base plate 119 in order to provide an easy release of the coupling from framework 104.

Turning now to the coupling 118 illustrated in FIG. 8, two pairs of supporting arms 129 and 130 (only one arm of each pair is shown) of identical length are articulated to the base plate 119 of coupling 118 and are pivotable about an axis 125. The pair of supporting arms 129 is oriented obliquely upwardly and the pair of supporting arms 130 is oriented obliquely downwardly.

To each pair of supporting arms there is articulated a threaded nut 132 which is pivotable about an axis 131. Both nuts 132 are threaded on a spindle 133 which has a right-handed thread 134 over half of its length and a left-handed thread 135 over the other half of its length. The two nuts 132 are held on different halves of the spindle.

The threaded nuts 132 have internal threads which correspond to these thread zones. A key seat 136 is shaped to the upper end portion of the spindle 133.

By rotating the spindle 133, the free end parts of the suppporting arms 129 and 130 can be clamped to a sheet pile 113 in a force transmitting manner so that the closed coupling 118 securely connects either a sheet pile 113 or 114 with the framework 104 in the pressing as well as pulling direction. By rotating the spindle 133 in the opposite direction, the coupling is released.

It is thus seen that advantageously, at those portions of the framework which is below the transverse head, couplings of the type shown in FIG. 9 (that is, couplings 117) are used, whereas at those portions of the framework which extend beyond the length dimension of the transverse head 101, couplings of the type shown in FIG. 8 (that is, couplings 118) are utilized. This may be well observed in FIG. 5.

For driving in the four sheet piles 109, the procedure is as follows: First the two center piles are pressed into the ground to a depth of about 50 cm. The outer sheet piles 109 serve as the holding members and the reaction forces exerted by the pressing devices 102 are transmitted to the framework 104 and the sheet piles 113, 114 coupled thereto. Then the outer piles 109 are pressed into the ground and the center piles 109 transfer the reaction forces to framework 104 and the piles 113, 114 coupled thereto. This operation is performed alternately until the selected depth for the piles has been reached.

At the beginning of the erection of the sheetpiling it is also possible, in order to realize high abutment forces, to provide, at both sides of the piles 109 connected to the piston rods of the pressing devices 102, only piles 114 which are to be driven in and to couple them with the framework 104.

Thus, in the apparatus described in connection with FIGS. 5–9, the reaction forces which are produced by the pressing devices during driving in of the sheet piles or the like and which act on the transverse head can be transferred to the framework when the weight of the cross head and of the pressing devices is not sufficient to compensate for these reaction forces.

The feature that the framework 104 (more particularly, the support beam pairs 108, 108') extends beyond the length dimension of the transverse head 101 and is thus clampingly connectable to the already driven-in sheet piles 113 and to the sheet piles 114 still to be driven in, has the advantage that much greater driving forces may be applied by the pressing devices than it has been previously possible. With this measure, the reaction forces occurring during the step-wise driving of one or a plurality of sheet piles directly connected to the transverse head 101 when the couplings associated with these sheet piles are released while all other couplings, i.e. the couplings associated with the sheet piles supported by the framework, remain closed, are absorbed by the gravity effect of the framework and also by the gravity effect of the piles not directly connected with the transverse head, i.e. the piles still to be driven in, and possibly also of the piles which are already driven in. This produces far higher abutment forces than previously possible so that much higher pressure forces can be exerted by the pressing devices 102.

Moreover, the anchor means, such as chains 5 used in the apparatus shown in FIG. 1 which connect the transverse head with the framework may be omitted from the apparatus illustrated in FIGS. 5–9. After driving in the sheet piles 109 as deep as desired, the transverse head 101 will be taken above the sheet piles 114 by a crane. Then the sheet piles 114 will be connected with the pressing devices 102.

It will be understood that the above description of the present invention is susceptible to various modifications, changes and adaptations, and the same are intended to be comprehended within the meaning and range of equivalents of the appended claims.

I claim:

1. A method of driving a sheet pile into the ground comprising driving a sheet pile into the ground and boring a hole adjacent said sheet pile, at least one part of the boring step being performed at a time when the pile is already in a partially driven-in state, said hole being of such distance from the pile as to provide at least partial space for the soil displaced by the pile.

2. A method of driving a sheet pile into the ground comprising boring a hole in the ground and driving a sheet pile into the ground adjacent said hole, said hole being of such distance from the pile as to provide at least partial space for the soil displaced by the pile.

3. In a method of introducing sheet pile planks into the ground, including the step of driving the planks into the ground, wherein the improvement comprises the step of drilling a bore hole simultaneously with the plank driving step adjacent the plank being driven for providing at least partial space for the soil displaced by the plank driving step; the cross-sectional area of the bore hole provided by said drilling step approximately corresponds to that of one sheet pile plank.

4. A method as defined in claim 3, wherein the drilling and the plank driving steps are performed simultaneously in stages.

5. A method as defined in claim 3, wherein the depth of the bore hole provided by said drilling step corresponds to that to which the planks are driven.

6. A method as defined in claim 3, wherein the plank driving step includes the application of static pressures to the planks.

7. A method as defined in claim 3, wherein the plank driving step includes the application of the pulsating pressures to the planks.

8. A method as defined in claim 3, wherein the plank driving step includes the application of superposed static and pulsating pressures to the planks.

9. A method as defined in claim 3, including the step of filling the remaining empty volume of the bore hole, after displacement hereinto of the soil as a result of the plank driving step, with a material subsequent to the completion of the plank driving step.

10. A method as defined in claim 9, wherein said material is a hardening material.

11. In an apparatus for driving pile sheet planks or the like into the ground, having a substantially horizontally supported head beam and a plank pressing device supported by and suspended from the head beam; the improvement comprising a drilling means supported by and suspended from said head beam adjacent said plank pressing device for drilling a hole in the ground adjoining the location where the plank is driven into the ground by said plank pressing device for providing a space that receives at least one part of the soil displaced by the plank upon operation of said plank pressing device.

12. In an apparatus as defined in claim 11, there is provided a plurality of plank pressing devices along said head beam; between two adjacent plank driving devices there is disposed a drilling device constituting said drilling means.

13. An apparatus as defined in claim 11, wherein said drilling means includes a hollow drill bit, hollow drill rods and a water swivel for introducing flushing fluid into the drill rods and the drill bit during the drilling operation.

14. In a method of introducing sheet pile planks into the ground, including the step of driving the planks into the ground, wherein the improvement comprises the step of drilling a bore hole simultaneously with the plank driving step adjacent the plank being driven for providing at least partial space for the soil displaced by the plank driving step; the ratio of the cross-sectional area of the bore hole to that of one sheet pile plank is approximately 2:7.

* * * * *